US007841888B2

(12) United States Patent
Xia et al.

(10) Patent No.: US 7,841,888 B2
(45) Date of Patent: Nov. 30, 2010

(54) POSITIVE LOCK CONNECTOR

(75) Inventors: YueXue Xia, Singapore (SG); Mui Lian Jessica Toh, Singapore (SG); Chee Foo Richard Loh, Singapore (SG)

(73) Assignee: Volex (Asia) Pte Ltd., Singapore (SG)

( * ) Notice: Subject to any disclaimer, the term of this patent is extended or adjusted under 35 U.S.C. 154(b) by 0 days.

(21) Appl. No.: 12/295,106

(22) PCT Filed: Apr. 27, 2007

(86) PCT No.: PCT/SG2007/000120

§ 371 (c)(1),
(2), (4) Date: Dec. 5, 2008

(87) PCT Pub. No.: WO2007/133165

PCT Pub. Date: Nov. 22, 2007

(65) Prior Publication Data

US 2009/0137142 A1 May 28, 2009

(30) Foreign Application Priority Data

May 11, 2006 (SG) ..... 200603238-7

(51) Int. Cl.
*H01R 13/627* (2006.01)

(52) U.S. Cl. ..... 439/354

(58) Field of Classification Search ..... 439/344, 439/353–358; 385/76, 78, 92
See application file for complete search history.

(56) References Cited

U.S. PATENT DOCUMENTS

| | | | | |
|---|---|---|---|---|
| 3,860,316 | A * | 1/1975 | Hardesty | 439/344 |
| 5,647,043 | A * | 7/1997 | Anderson et al. | 385/78 |
| 5,989,050 | A | 11/1999 | Lee-Chang | |
| 6,371,796 | B2 * | 4/2002 | Fukuda | 439/489 |
| 6,540,543 | B1 * | 4/2003 | Watanabe | 439/354 |
| 2004/0202431 | A1 | 10/2004 | Bates, III | |

FOREIGN PATENT DOCUMENTS

| | | |
|---|---|---|
| CZ | 20004144(A3) | 12/1999 |
| EP | 0762558 | 3/1997 |
| SK | 283456(B3) | 8/2003 |

* cited by examiner

*Primary Examiner*—Neil Abrams
(74) *Attorney, Agent, or Firm*—Occhiuti Rohlicek & Tsao LLP

(57) ABSTRACT

A connector assembly includes a connector having a housing portion, first terminals mounted therein for supplying electrical power, and a resilient locking member moveable between an outwardly disposed locked position and an inwardly disposed unlocked position, and biased towards the locked position. The assembly includes an appliance inlet having a cavity portion to receive the connector, second terminals to contact and receive electrical power from the first terminals when the connector is received in the cavity portion, and a recess disposed in the cavity. The locking member engages the recess thereby preventing the connector's removal from the appliance inlet when the connector is received therein, and disengageable from the recess thereby allowing the connector's removal from the appliance inlet by forcing to the locking member in a direction inwardly of the connector. The locking projection includes stepped portions arranged to cooperate with the appliance inlet to provide multiple locking positions.

9 Claims, 4 Drawing Sheets

POSITIVE LOCK CONNECTOR

CROSS-REFERENCE TO RELATED APPLICATIONS

This application is a 371 US National Phase of International Application No. PCT/SG2007/000120, filed on Apr. 27, 2007, which claims the priority of Singapore Application No. 200603238-7, filed on May 11, 2006. The contents of both applications are hereby incorporated by reference in their entirety.

FIELD OF THE INVENTION

The present invention relates to an interlocking connector assembly of the type including a connector for supplying electrical power, and an appliance inlet for receiving electrical power, for example of the type in accordance with International Standard IEC 60320-1, and to a connector and an appliance inlet for use with such a connector assembly.

BACKGROUND OF THE INVENTION

It is known to provide a connector assembly including a connector and an appliance inlet, for example in personal computers wherein an appliance inlet is mounted on the personal computer and a connector in electrical communication with a source of electrical power is engaged with the appliance inlet in order to supply electrical power to the personal computer.

However, such a connector assembly provides a relatively insecure connection and a significant risk exists that the connector will inadvertently disengage from the appliance inlet potentially causing damage to the appliance and/or injury to a user.

SUMMARY OF THE INVENTION

In accordance with an aspect of the present invention, there is provided a connector assembly comprising:

a connector comprising a housing portion, first electrical terminals mounted in the housing portion for supplying electrical power, and a resilient locking member moveable between an outwardly disposed locked position and an inwardly disposed unlocked position, the locking member being biased towards the locked position; and an appliance inlet comprising a cavity portion arranged to receive the connector, second electrical terminals arranged to contact and receive electrical power from the first electrical terminals when the connector is received in the cavity portion, and a recess disposed in the cavity;

the locking member engaging with the recess thereby preventing removal of the connector from the appliance inlet when the connector is received in the appliance inlet, and being disengageable from the recess thereby allowing removal of the connector from the appliance inlet by application of a force to the locking member in a direction inwardly of the connector.

In one arrangement, the locking member is an integrally formed part of the housing portion. The locking member may include a locking projection. The locking member may further include a button portion which, when pressed, effects movement of the locking projection so as to disengage the locking projection from the recess.

The locking projection may comprise a generally flat surface and a ramp portion, the ramp portion serving to urge the locking projection to move inwardly of the connector during insertion of the connector into the appliance inlet, and the flat surface serving to engage securely with a wall of the recess in order to prevent unintentional disengagement of the locking projection from the recess.

In one arrangement, the locking projection includes a stepped portion arranged to cooperate with the appliance inlet so as to provide multiple locking positions.

The connector may further comprise a housing portion and a connector moulding disposed over the housing portion. In one arrangement, the connector further comprises a stop block arranged to retain the locking member relative to the housing portion during an over moulding process.

In accordance with a second aspect of the present invention, there is provided a connector comprising a housing portion, first electrical terminals mounted in the housing portion for supplying electrical power, and a resilient locking member moveable between an outwardly disposed locked position and an inwardly disposed unlocked position, the locking member being biased towards the locked position;

the connector being arranged so as to be engagable with an appliance inlet comprising a cavity portion, second electrical terminals, and a recess disposed in the cavity such that the locking member engages with the recess thereby preventing removal of the connector from the appliance inlet when the connector is received in the appliance inlet; and the connector being arranged so as to be disengageable from the recess thereby allowing removal of the connector from the appliance inlet by application of a force in a direction inwardly of the connector.

In accordance with a third aspect of the present invention, there is provided an appliance inlet comprising:

a cavity portion, inlet electrical terminals for receiving power during use for an appliance associated with the appliance inlet, and a recess disposed in the cavity;

the appliance inlet being arranged to receive a connector having connector electrical terminals for supplying electrical power, and a resilient locking member moveable between an outwardly disposed locked position and an inwardly disposed unlocked position; and the appliance inlet being arranged such that the locking member engages with the recess thereby preventing removal of the connector from the appliance inlet when the connector is received in the appliance inlet.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
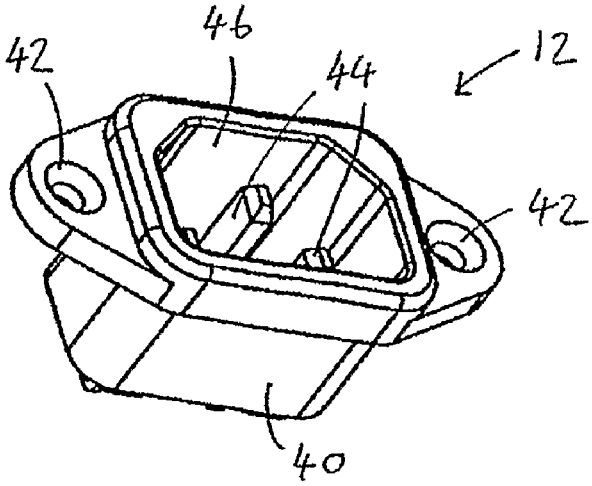
FIG. 1 is a diagrammatic perspective view of an appliance inlet in accordance with an embodiment of the present invention, the appliance inlet forming part of a connector assembly in accordance with an embodiment of the present invention.
Figure 2:
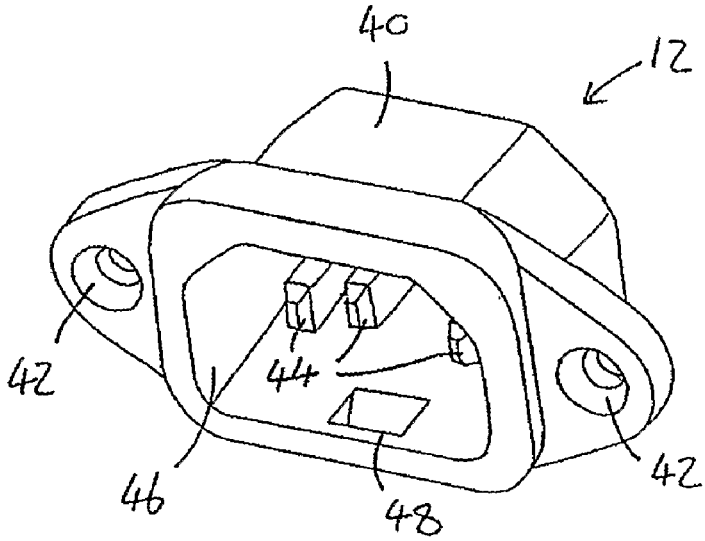
FIG. 2 is a further perspective view of the appliance inlet shown in FIG. 1.
Figure 3:
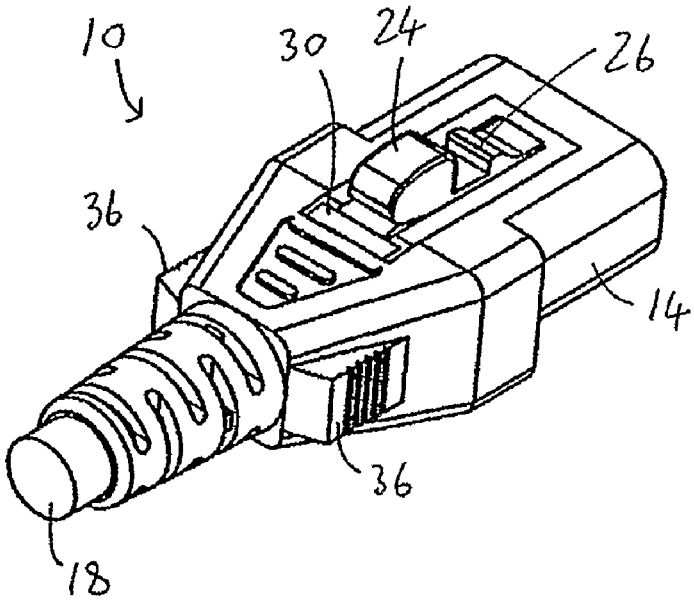
FIG. 3 is a diagrammatic perspective view of a connector in accordance with an embodiment of the present invention, the connector forming part of a connector assembly in accordance with an embodiment of the present invention.
Figure 4:
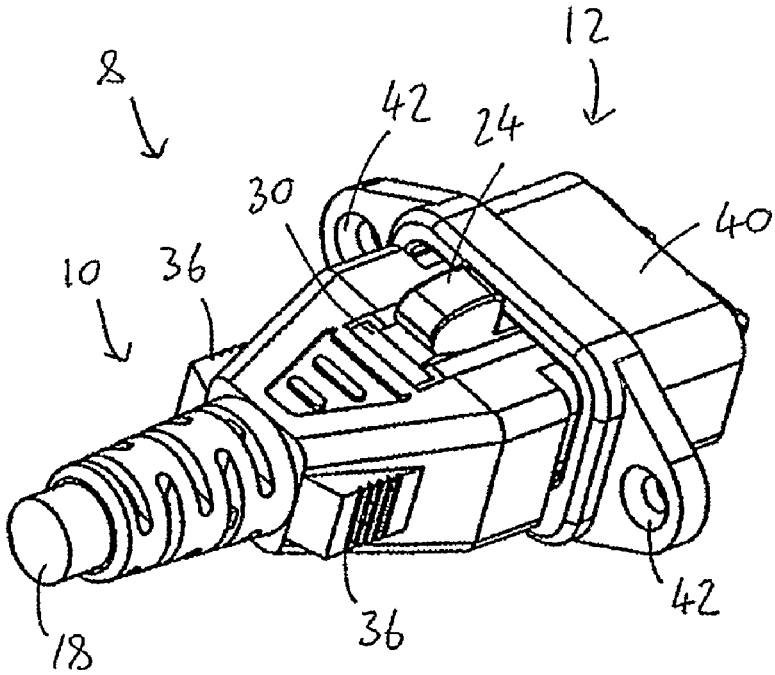
FIG. 4 is a diagrammatic perspective view of a connector assembly in accordance with an embodiment of the present invention, the connector assembly including the connector shown in FIG. 3 and the appliance inlet shown in FIGS. 1 and 2.

Referring to the drawings, in FIG. 4 there is shown a connector assembly 8 which includes a connector 10 shown in FIG. 3 and an appliance inlet 12 shown in FIGS. 1 and 2.

It will be understood that in this specification a "connector" is of a type for supplying electrical power to an appliance, the connector being in electrical connection with a power cord, and an "appliance inlet" is of a type for receiving electrical power from the connector, the appliance inlet being mounted on an electrical appliance. In this example, the connector 10 and appliance inlet 12 are in accordance with International Standard IEC 60320-1, although it will be understood that other types are envisaged.

The appliance inlet 12 is mounted during use on an electrical appliance and serves to receive electrical power for the appliance. The connector 10 is engageable with the appliance inlet 12 and serves to supply electrical power to the appliance inlet 12 and thereby the appliance when the connector 10 is engaged with the appliance inlet 12.

Figure 8:
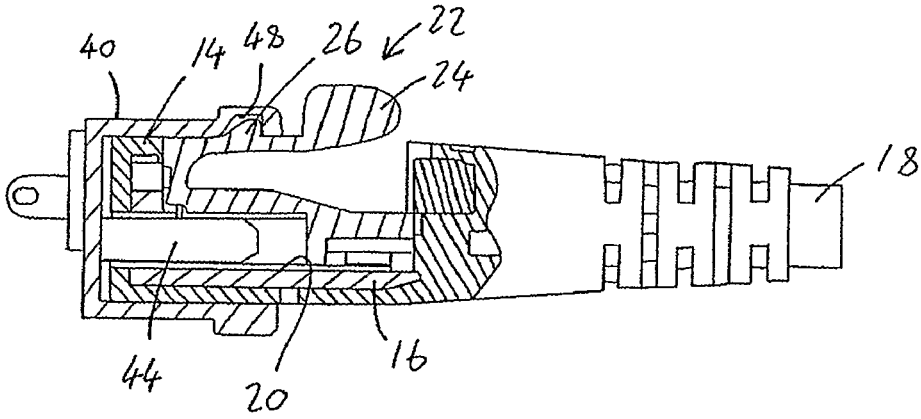
FIG. 8 is a diagrammatic cross-sectional view of the connector assembly shown in FIG. 4.

The connector 10 includes a connector moulding 14 and a housing portion 16 shown more particularly in FIG. 8, the connector moulding 14 being formed over the housing portion 16 using a conventional over moulding process. In electrical connection with the housing portion 16 is a power cord 18 which supplies power to the connector 10 during use.

As shown more particularly in FIG. 8, the housing portion 16 is provided with electrical terminals 20 in electrical connection with the power cord 18, and a resilient locking member 22 which serves to lock the connector 10 relative to the appliance inlet 12, and to permit selective unlocking of the connector 10 from the appliance inlet 12 and thereby allow withdrawal of the connector 10 from the appliance inlet 12. The locking member 22 includes a button portion 24 and a locking projection 26, and the button portion 24 and the locking projection 26 are resiliently movable inwardly of the connector 10 by application of a force to the button portion 24.

Figure 5:
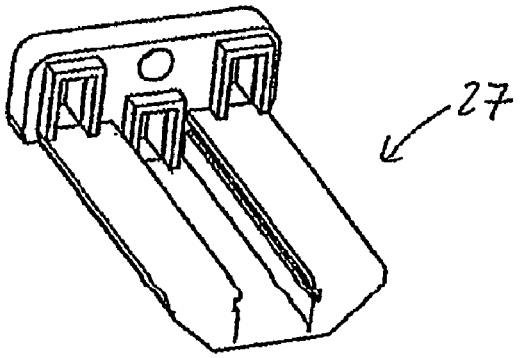
FIG. 5 is a diagrammatic perspective view of a housing cover portion of the connector shown in FIG. 3.
Figure 6:
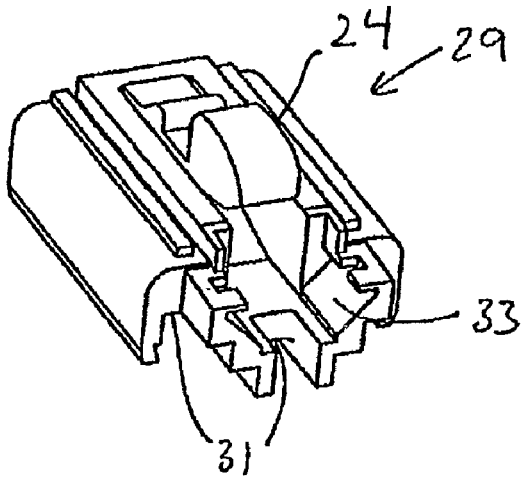
FIG. 6 is a diagrammatic perspective view of a housing base portion of the connector shown in FIG. 3.
Figure 7:
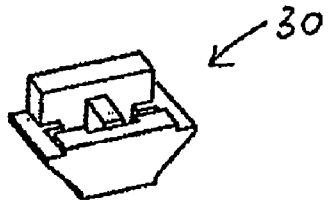
FIG. 7 is a diagrammatic perspective view of a stop block of the connector shown in FIG. 3.

As shown more particularly in FIGS. 5, 6 and 7, the housing portion 16 includes a housing cover portion 27, a housing base portion 29 and a stop block 30. The housing base portion 29 includes channels 31 for receiving the electrical terminals 20, and in this example the locking member 22 is integrally formed with the housing base portion 29.

The housing base portion 29 and the housing cover portion 27 are arranged such that the housing cover portion 27 is connectable to the housing base portion 29 by slidably engaging the housing cover portion 27 with the housing base portion 29.

The housing base portion 29 also includes a receptacle 33 configured so as to receive the stop block 30. The arrangement is such that when the stop block 30 is engaged with the receptacle 33 and a moulding is disposed over the housing portion 16 during a conventional over moulding process, the material used for the over moulding process is not able to pass underneath the button portion 24 and the locking projection 26.

During manufacture of the connector 10, the electrical terminals 20 are disposed in the channels 31 and the housing cover portion 27 is slidably engaged with the housing base portion 29 so as to retain the connectors 20 in position. The stop block 30 is then received in the receptacle 33 and a moulding disposed over the housing portion 16 using a conventional over moulding process.

The connector 10 also includes grip portions 36 which allow a user to securely hold the connector 10 when the connector 10 is withdrawn from the appliance inlet 12.

The appliance inlet 12 includes an inlet moulding 40 provided with integral fixing apertures 42, and electrical pins 44 which engage with the electrical terminals 20 of the connector 10 when the connector 10 is engaged with the appliance inlet 12 during use, the electrical pins 44 in this way receiving electrical power for the appliance associated with the appliance inlet 12.

The inlet moulding 40 defines a cavity 46 shaped so as to receive the connector 10. A recess 48 is formed in the cavity 46, the recess 48 serving to receive the locking projection 26 when the connector 10 is engaged with the appliance inlet 12 during use and thereby lock the connector 10 relative to the appliance inlet 12.

The arrangement is such that when the connector 10 is inserted into the appliance inlet 12, the locking member 22 and the button portion 24 flex inwardly of the connector 10 until the locking projection 26 is aligned with the recess 48. When this occurs, the button portion 24 and the locking projection 26 flex outwardly of the connector 10 by virtue of the resilient bias of the locking member 22 until the locking member 22 engages in the recess 48. In this way, the locking projection 26 and the recess 48 cooperate so as to prevent unintentional disengagement of the connector 10 from the appliance inlet 12.

When the connector 10 is desired to be removed from the appliance inlet 12, a user applies an inwardly directed force to the button portion 24 which causes the locking projection 26 to move inwardly of the connector 10 and out of engagement with the recess 48. A user is then able to withdraw the connector 10 from the appliance inlet 12.

Figure 9:
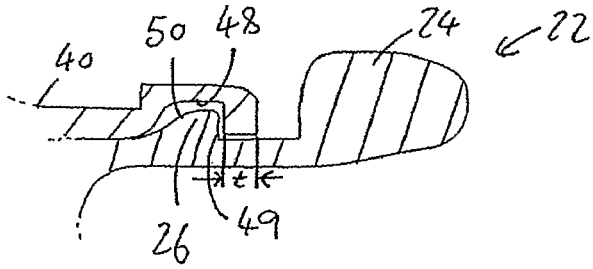
FIG. 9 is a diagrammatic enlarged view of part of the connector assembly shown in FIG. 8.

As shown in FIG. 9, the locking projection 26 is shaped so as to include a generally flat surface 49 and a ramp 50. The ramp 50 serves to urge the button portion 24 and the locking projection 26 to move inwardly of the connector 10 during insertion of the connector 10 into the appliance inlet 12, and the flat surface 49 serves to engage securely with a wall of the recess 48 in order to prevent unintentional disengagement of the locking projection 26 from the recess 48.

Figure 10:
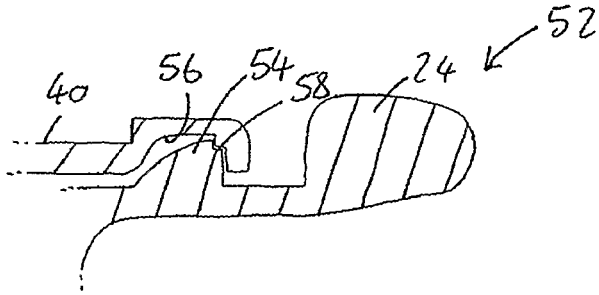
FIG. 10 is a diagrammatic enlarged cross-sectional view which corresponds with the enlarged view shown in FIG. 9 but including an alternative connection mechanism.

An alternative locking member 52 with an alternative shaped locking projection 54 and associated alternative shaped recess 56 as shown in FIG. 10. Like and similar features are indicated with like reference numerals.

As shown in FIG. 10, the alternative locking projection 54 and the alternative recess 56 are each provided with a stepped portion 58 which serves to provide two locking positions.

It will be understood that the configuration of the locking member 22 and/or the recess 48 may be varied depending on the desired locking force. For example, a locking force between 5 and 25 kg may be achieved by varying the thickness t of the recess wall 25 shown in FIG. 9.

Modifications and variations as would be apparent to a skilled addressee are deemed to be within the scope of the present invention.

The invention claimed is:

1. A connector assembly comprising:

a connector comprising a housing portion, first electrical terminals mounted in the housing portion for supplying electrical power, and a resilient locking member moveable between an outwardly disposed locked position and an inwardly disposed unlocked position, the locking member being an integrally formed part of the housing portion and being biased towards the locked position; and an appliance inlet comprising a cavity portion arranged to receive the connector, second electrical terminals arranged to contact and receive electrical power from the first electrical terminals when the connector is received in the cavity portion, and a recess disposed in the cavity;

wherein the locking member engages with the recess thereby preventing removal of the connector from the appliance inlet when the connector is received in the appliance inlet, and is disengageable from the recess thereby allowing removal of the connector from the appliance inlet by application of a force to the locking member in a direction inwardly of the connector, the locking member including a locking projection receivable in the recess and the locking projection including a stepped portion arranged to cooperate with the appliance inlet so as to provide multiple locking positions.

2. A connector assembly as claimed in claim 1, wherein the locking member includes a button portion which, when pressed, effects movement of the locking projection so as to disengage the locking projection from the recess.

3. A connector assembly as claimed in claim 1, wherein the locking projection comprises a generally flat surface and a ramp portion, the ramp portion serving to urge the locking projection to move inwardly of the connector during insertion of the connector into the appliance inlet, and the flat surface serving to engage securely with a wall of the recess in order to prevent unintentional disengagement of the locking projection from the recess.

4. A connector assembly as claimed in claim 1, wherein the configuration of the locking member and/or the recess is/are selected so as to define a desired locking force.

5. A connector assembly as claimed in claim 4, wherein the desired locking force is defined by varying a thickness of the wall of the recess.

6. A connector comprising:

a housing portion, first electrical terminals mounted in the housing portion for supplying electrical power, and a resilient locking member moveable between an outwardly disposed locked position and an inwardly disposed unlocked position, the locking member being an integrally formed part of the housing portion and being biased towards the locked position;

the connector being arranged so as to be engagable with an appliance inlet comprising a cavity portion, second electrical terminals, and a recess disposed in the cavity such that the locking member engages with the recess thereby preventing removal of the connector from the appliance inlet when the connector is received in the appliance inlet; and the connector being arranged so as to be disengageable from the recess thereby allowing removal of the connector from the appliance inlet by application of a force in a direction inwardly of the connector;

wherein the locking member includes a locking projection and the locking projection includes a stepped portion arranged to cooperate with the appliance inlet so as to provide multiple locking positions.

7. A connector as claimed in claim 6, wherein the locking member includes a button portion which, when pressed, effects movement of the locking projection so as to disengage the locking projection from the recess.

8. A connector as claimed in claim 6, wherein the locking projection comprises a generally flat surface and a ramp portion, the ramp portion serving to urge the locking projection to move inwardly of the connector during insertion of the connector into the appliance inlet, and the flat surface serving to engage securely with a wall of the recess in order to prevent unintentional disengagement of the locking projection from the recess.

9. An appliance inlet comprising:

a cavity portion, inlet electrical terminals for receiving power during use for an appliance associated with the appliance inlet, and a recess disposed in the cavity;

the appliance inlet being arranged to receive a connector having connector electrical terminals for supplying electrical power, and a resilient locking member moveable between an outwardly disposed locked position and an inwardly disposed unlocked position; and the appliance inlet being arranged such that the locking member engages with the recess thereby preventing removal of the connector from the appliance inlet when the connector is received in the appliance inlet;

wherein the locking member includes a locking projection and the locking projection includes a stepped portion arranged to cooperate with the appliance inlet so as to provide multiple locking positions.

* * * * *